US006861932B2

(12) United States Patent
Shinoura et al.

(10) Patent No.: US 6,861,932 B2
(45) Date of Patent: Mar. 1, 2005

(54) ELECTROMAGNETIC RELAY

(75) Inventors: Tatsuo Shinoura, Kyoto (JP); Mitushiro Kawai, Kyoto (JP); Shishido Jun, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/157,022

(22) Filed: May 30, 2002

(65) Prior Publication Data

US 2002/0196111 A1 Dec. 26, 2002

(30) Foreign Application Priority Data

May 30, 2001 (JP) ..... 2001-162557

(51) Int. Cl.[7] ..... H01H 51/22
(52) U.S. Cl. ..... 335/78; 335/83; 335/202
(58) Field of Search ..... 335/78–86, 124, 335/128–132, 202, 274; 439/607–610

(56) References Cited

U.S. PATENT DOCUMENTS 4,740,771 A * 4/1988 Motoyama et al. ..... 335/274
5,025,238 A * 6/1991 Matuo et al. ..... 335/128
6,140,895 A * 10/2000 Dittmann et al. ..... 335/80
2002/0081903 A1 * 6/2002 Yang ..... 439/607

* cited by examiner

*Primary Examiner*—Lincoln Donovan
(74) *Attorney, Agent, or Firm*—Morrison & Foerster LLP

(57) ABSTRACT

An electromagnetic relay for high frequency signal switching is provided. The electromagnetic relay has a small size, high isolation characteristics, and small loss. Fixed terminals are supported by the sides of a base composed of a dielectric material and having an internal space. A fixed contact on each fixed terminal is exposed to the internal space. The surface of the fixed terminal is disposed parallel to the bottom of the base, while a movable block is disposed in the internal space of said base. Signal lines are formed from the fixed terminals and a movable contact piece. Shielding portions to be grounded are disposed at either upper or lower part of the internal space corresponding to the signal lines.

13 Claims, 13 Drawing Sheets

ELECTROMAGNETIC RELAY

BACKGROUND OF THE INVENTION

1. Field of the Invention

The present invention relates to an electromagnetic relay suitable for a high-frequency switching.

2. Description of the Related Art

Conventionally, a microstrip line structure is known as an electromagnetic relay suitable for high-frequency switching.

For example, Japanese Unexamined Patent Publication No. 6-12957 discloses an electromagnetic relay for high-frequency switching, in which a movable block disposed on a base having a grounding portion provided at the lower or upper plane of the base drives a movable contact piece at its side to open or close the contact point and thereby to transmit a high frequency signal through signal lines formed of fixed contact pieces and movable contacts.

Generally, in this kind of high-frequency electromagnetic relay, the entire case is composed of shielding plates, or the contact switching portion is covered with a shielding plate, and the shielding plates are grounded to enhance isolation.

However, in an electromagnetic relay which is mounted on a printed wiring board of this kind, a microstrip structure is used to reduce the size. However, since the members are packed at a high density, such as movable iron pieces of driving parts and movable contact pieces in the contact switching parts, the internal space in the electromagnetic relay is limited. Therefore, it is hard to form shielding portions in a wide range around signal lines to heighten isolation in such a small space. If a sufficient shielding structure is achieved, the entire size is increased. Further, if the signal lines including movable contact pieces are apart from the base upward, the loss is increased.

It is therefore an object of the invention to present an electromagnetic relay for high frequency signal switching operations which is small, has high isolation characteristics, and little loss.

SUMMARY OF THE INVENTION

The invention comprises plural fixed terminals having fixed contacts, a movable block holding a movable contact piece having a movable contact contacting with and departing from the fixed contacts, and an electromagnetic block for driving the movable block, in which the fixed contacts are opened or closed by driving the movable block by exciting or non-exciting the electromagnet to transmit or shield a high frequency signal, each fixed terminal is supported by the side of the base composed of a dielectric element and having an internal space, the fixed contact of each fixed terminal is exposed to the internal space, the surface of the fixed terminal is disposed parallel to the bottom of the base, while the movable block is disposed in the internal space of the base, signal lines are formed of the fixed terminals and movable contact piece, and shielding portions to be grounded are disposed at either upper part or lower part of the internal space corresponding to the signal lines.

In this configuration, a microstrip line structure is obtained by shielding portions and signal lines, and the contact switching portion is positioned within the internal space. The surrounding is enclosed by an air layer so that the isolation is enhanced. When mounted on a printed wiring board the signal lines can be positioned parallel along the vicinity of the printed wiring board so that the loss can be kept to a minimum.

Preferably, the internal space of the base is covered by positioning the shielding portions at the upper and lower planes and four sides of the base. Therefore, isolation is further enhanced, and loss can be suppressed.

Preferably, the shielding portions are disposed at the upper and lower planes of the base, and are mutually electrically connected. Therefore, a shielding effect is obtained in almost the entire region of the signal lines so that higher isolation may be obtained.

Preferably, the movable block is disposed in the guide portion formed inside of the internal space of the base, and is composed of a support portion supported movably in vertical direction, and a movable contact piece having a movable contact to contact with and depart from the fixed contact at both ends extended from the support portion.

Preferably, the guide portion supports the support portion of the movable block so as to be movable vertically by partial contact. Therefore, the support state is stabilized.

Preferably, thrusting means for thrusting the movable contact piece in an open or closed state is provided in the upper or lower plane of the base. Therefore, the operation state of the movable contact piece is stabilized.

Preferably, protrusions for abutting against the movable contact piece in the open state to maintain a constant distance between contacts are provided in the shielding portions.

Preferably, recesses for keeping a constant distance to the signal lines to maintain a constant impedance characteristic are formed in the shielding portions.

Preferably, the lower plane of the base is formed in the shielding portions, and protrusions are formed in the shielding portions. Preferably, the lower plane of the base is formed in the shielding portions, and a stand-off is formed to provide a clearance between the lower plane of the base and the upper plane of a printed wiring board when contacting the upper plane of the printed wiring board.

Preferably, a shielding plane to be grounded is formed at least in an area where shielding portions are not provided, in the inside of the internal space of the base. Therefore, high frequency characteristics may be further enhanced.

Preferably, the shielding portions are provided in the lower plane of the base, and the characteristic impedance is kept constant by bending the signal terminal extended from the base and connected to the signal lines to maintain a specified dimension to the shielding portions. Therefore, the characteristic impedance may be kept constant.

Preferably, earth terminals to be connected to the shielding portions provided in the lower plane of the base are disposed at both sides of the signal terminal extending from the base and connected to the signal line. Therefore, isolation can be enhanced at the signal terminal.

DESCRIPTION OF THE PREFERRED EMBODIMENTS

Preferred embodiments of the invention are described below while referring to the accompanying drawings.

Figure 1A:
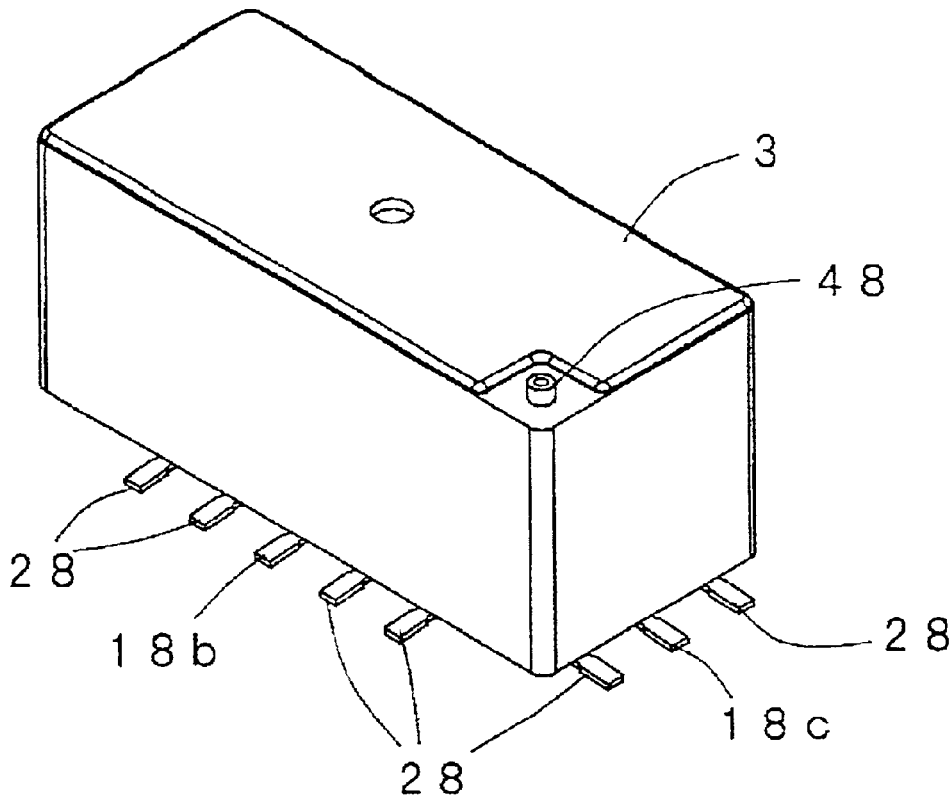
FIG. 1A is an upward side perspective view of an electromagnetic relay in an embodiment of the invention.
Figure 1B:
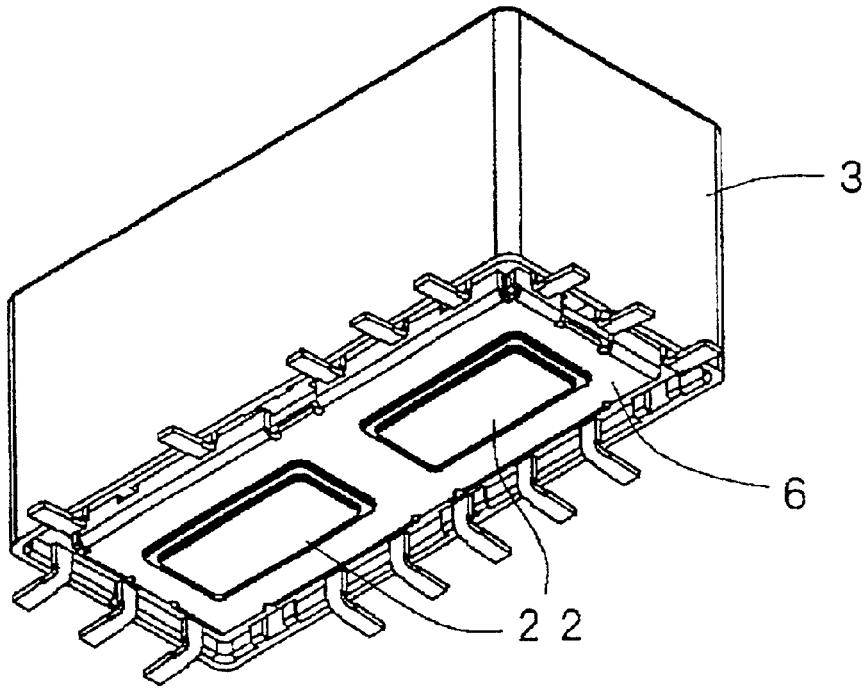
FIG. 1B is its downward side perspective view.
Figure 2:
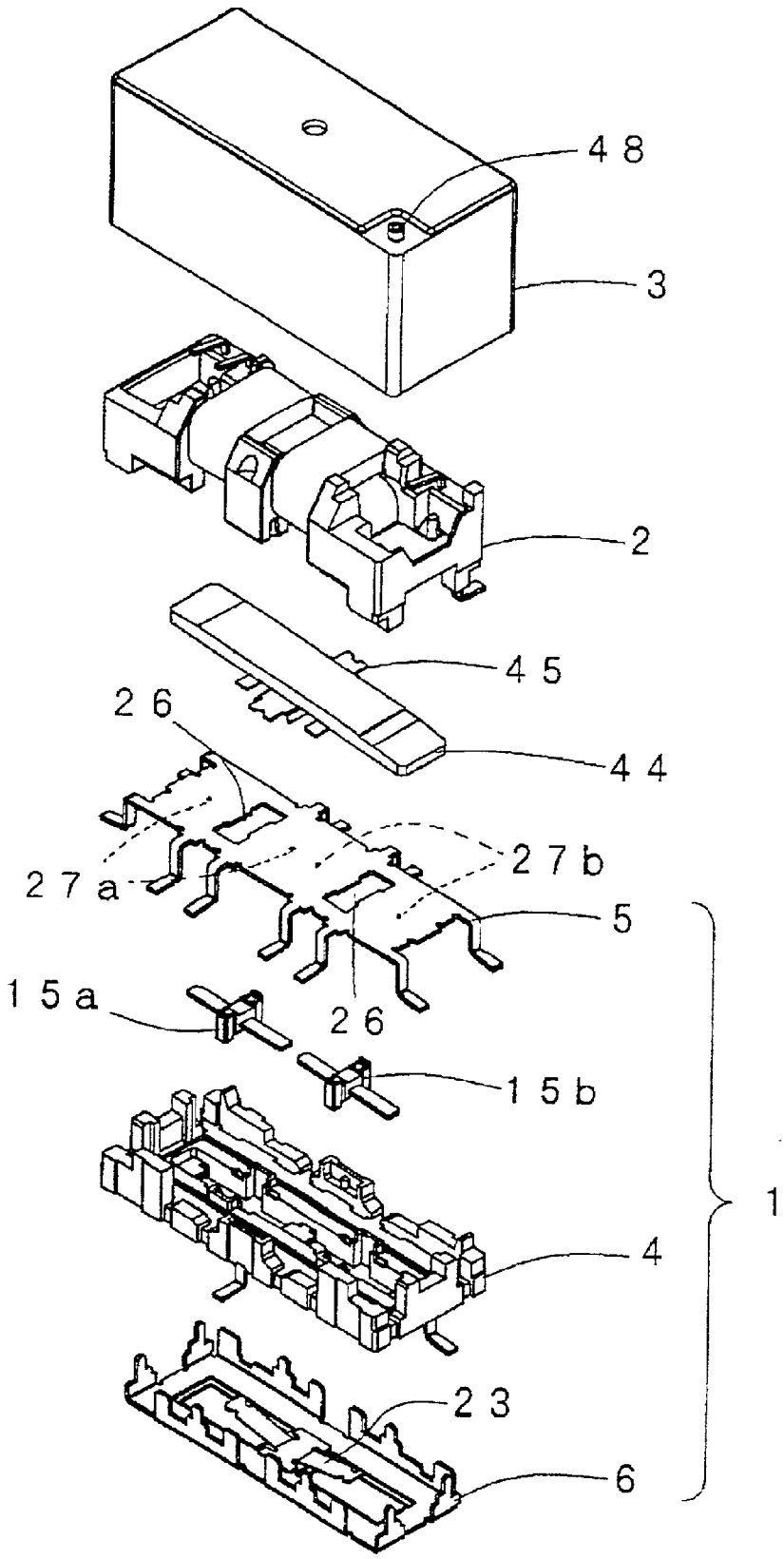
FIG. 2 is an exploded perspective view of the electromagnetic relay shown in FIG. 1.

FIGS. 1(*a*) and (*b*) and FIG. 2 show an electromagnetic relay in an embodiment of the invention. The electromagnetic relay is mainly composed of a base block 1, an electromagnet block 2, and a case 3.

The base block 1 is composed of a base 4, an upper shielding plate 5, and a lower shielding plate 6.

Figure 3A:
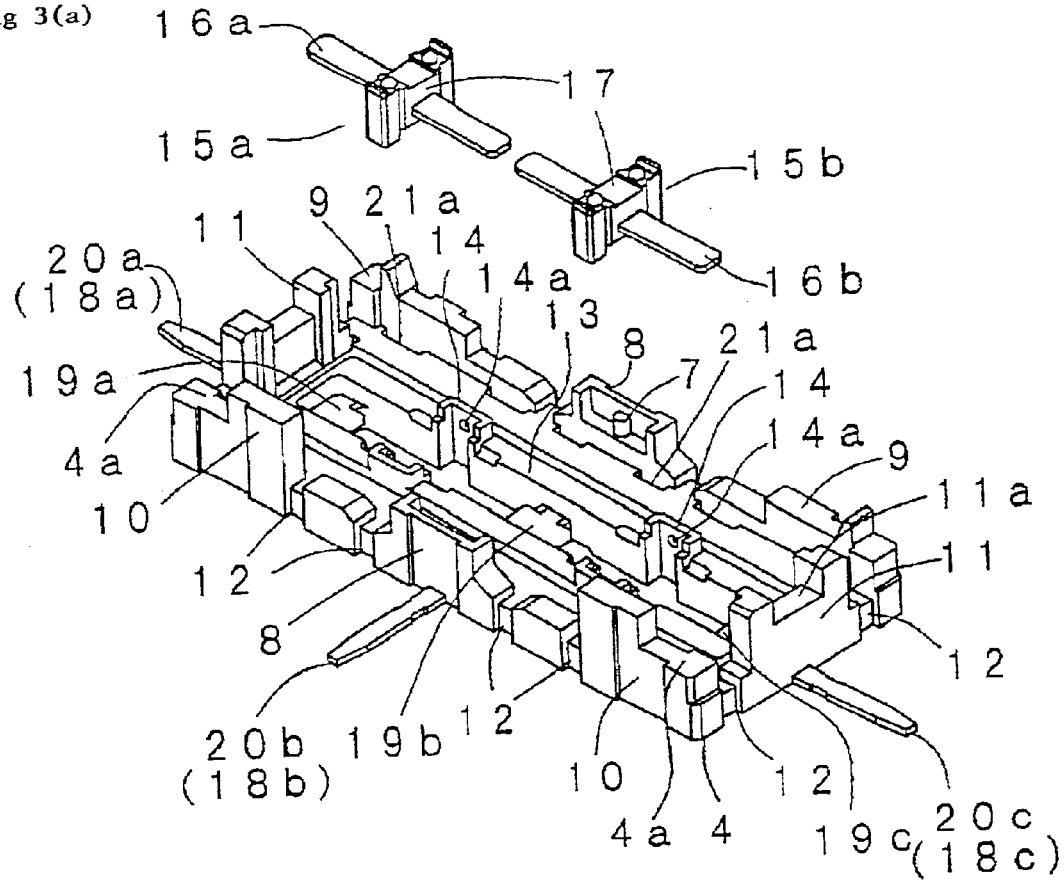
FIG. 3A is an upward side perspective view of the base and the movable block in FIG. 2.
Figure 3B:
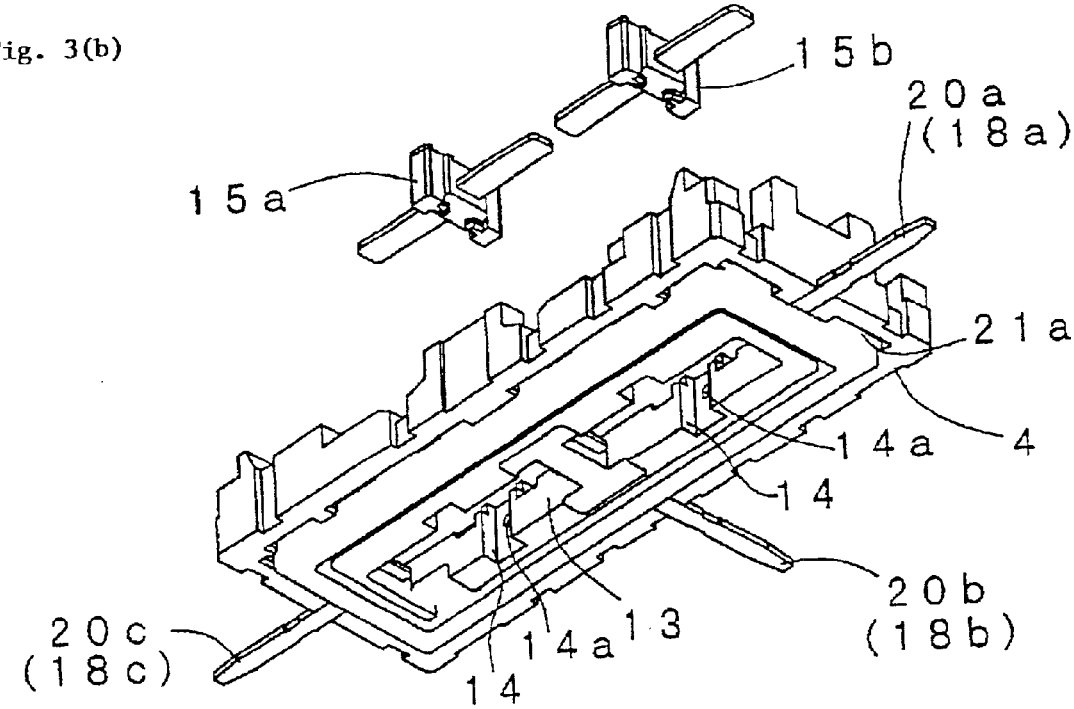
FIG. 3B is its downward side perspective view.

The base 4 is a nearly rectangular dielectric element made of synthetic resin or the like as shown in FIGS. 3(*a*) and (*b*). In the middle of both sides of the upper plane of the base 4, a guide wall 8, having a stopping protrusion 7, is formed. On the upper plane of the base 4, a first side wall 9 and a second side wall 10 are formed at both sides of the guide wall 8, and third side walls 11 at both ends. Fitting recesses 4*a* are formed among the first side wall 9, second side wall 10, and third side walls 11. Recesses 11*a* are formed on the top of the third side walls 11. Plural relief grooves 12 are formed at the side of the base 4. In the middle of the base 4, a rectangular opening 13 is formed. Guide grooves 14 are formed at two confronting positions of the inside of the both sides of the rectangular opening 13. On the confronting planes of the guide grooves 14, hemispherical protrusions 14*a* are formed, and movable blocks 15*a*, 15*b* are guided to be vertically movable. The movable blocks 15*a*, 15*b* are the middle parts of the movable contact pieces 16*a*, 16*b*, which are made of conductive plate materials and supported by a support portion 17, which is made of a synthetic resin material. The protrusion 14*a* of the guide groove 14 is hemispherical, but it may also be formed in linearly or in any other shape. The protrusion 14*a* may be also formed at the support portion 17 side. However, the placement is not particularly specified as long as the support state of the movable blocks 15*a*, 15*b* by the guide grooves 14 can be stably held. Fixed terminals 18*a*, 18*b*, 18*c* are integrally formed at the both ends and in the middle of the base 4. Fixed contact points 19*a*, 19*b*, 19*c* of the fixed terminals 18*a*, 18*b*, 18*c* are respectively exposed to both ends and middle of the opening 18. A contact switching portion is formed of the both ends (movable contact portions) of the movable contact pieces 16*a*, 16*b*, and fixed contact portions 19*a*, 19*b*, 19*c*. Terminals 20*a*, 20*b*, 20*c* are bent in stairs, and are extended from the lower plane to both ends and sideways to maintain a specified clearance between the lower shielding plate 6 and upper shielding plate 5, as mentioned below. A recess 21 is formed in the bottom of the base 4. Slits 21*a* are formed in plural positions at the edge of the recess 21.

Figure 4A:
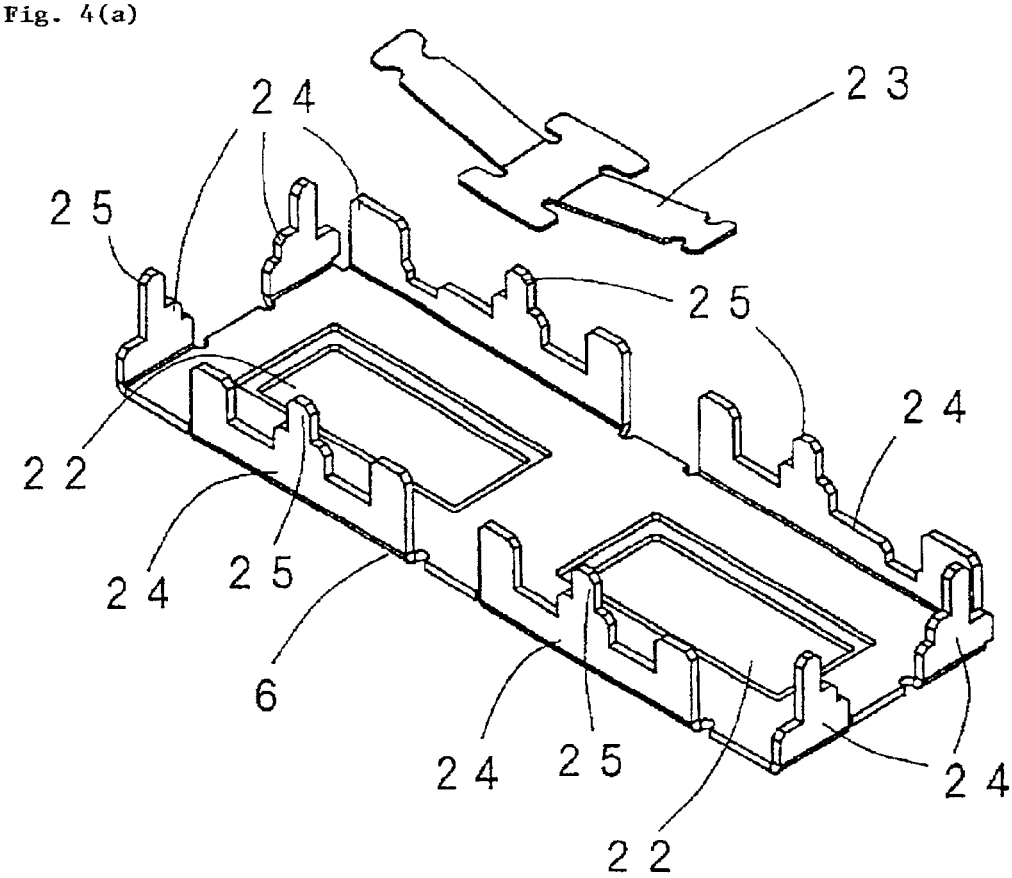
FIG. 4A is an upward side perspective view of the lower shielding plate and the return spring in FIG. 2.
Figure 4B:
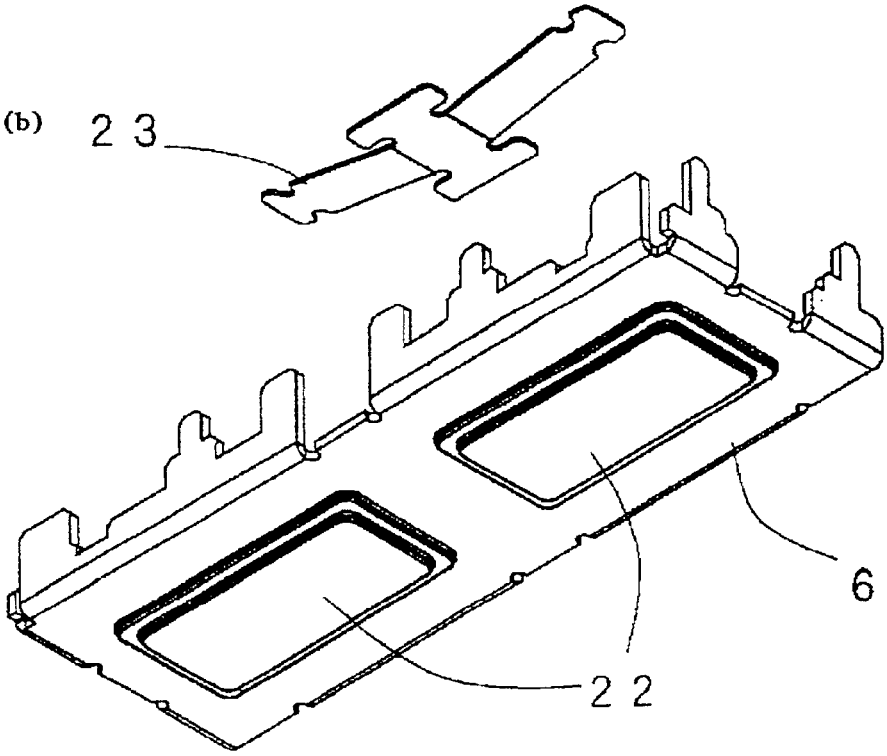
FIG. 4B is its downward side perspective view.

The lower shielding plate 6 is made of a rectangular conductive plate as shown in FIGS. 4(*a*) and (*b*), and stand-offs 22 projecting downward are formed in two recesses along the longitudinal direction, respectively. Each stand-off 22 forms a clearance between the printed wiring board and the base 4 when mounted on the printed wiring board, and prevents invasion of flux during soldering. However, when the recess is formed to keep the distance constant between the fixed terminals 18*a*, 18*b*, 18*c* and movable contact pieces 16*a*, 16*b*, the stand-off 22 can function to enhance the characteristic impedance. The lower shielding plate 6 composes the lower plane of the base 4, and a return spring 23 is provided in the middle of the upper plane. The return spring 23 is pressed against the bottom of the support portion 17 of the movable blocks 15*a*, 15*b* at both ends, and thrusts the movable contact pieces 16*a*, 16*b* toward the upper shielding plate 5. At the edge of the lower shield plate 6, raised walls 24 are formed in plural positions, and are positioned in the slits 21*a* of the base 4, thereby enhancing the side insulation to the internal space of the base 4. At the upper edge of the raised walls 24, a stopping piece 25 to be stopped by the upper shielding plate 5 is projected upward so as to be inserted in the slit 21*a* of the base 4 and folded in a substantially right-angle direction.

The upper shielding plate 5 is formed of a rectangular conductive plate as shown in FIG. 2. Rectangular insertion holes 26 are drilled in the two positions in the longitudinal direction, and the movable block 15 is movably positioned in the vertical direction. As the both sides of each insertion hole 26 is pushed out downward, earth contacts 27*a*, 27*b* (see FIG. 12) are formed. The earth contacts 27*a*, 27*b* alternately contact with and depart from both ends (movable contact portions) of the movable contact piece 16 of each movable block 15 to keep a constant distance (distance between contact points) of the fixed contacts 19*a*, 19*b*, 19*c*. Plural earth terminals 28 extend downward from the edge of the upper shielding plate 5. Each earth terminal 28 is disposed in the relief groove 12 formed at the side of the base 4.

The electromagnet block 2 is composed by disposing an iron core 30 and a permanent magnet 31 in a spool 29, and winding a coil 32.

Figure 5A:
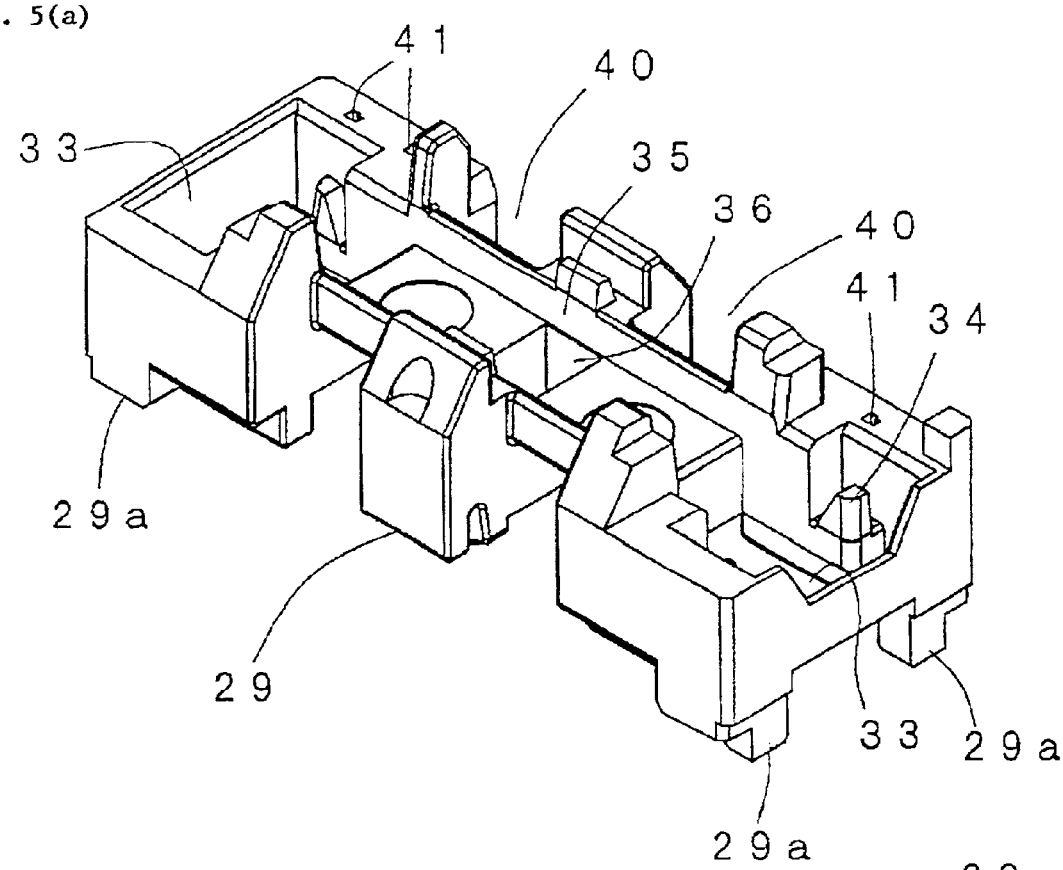
FIG. 5A is an upward side perspective view of the spool for composing an electromagnetic block in FIG. 2.
Figure 5B:
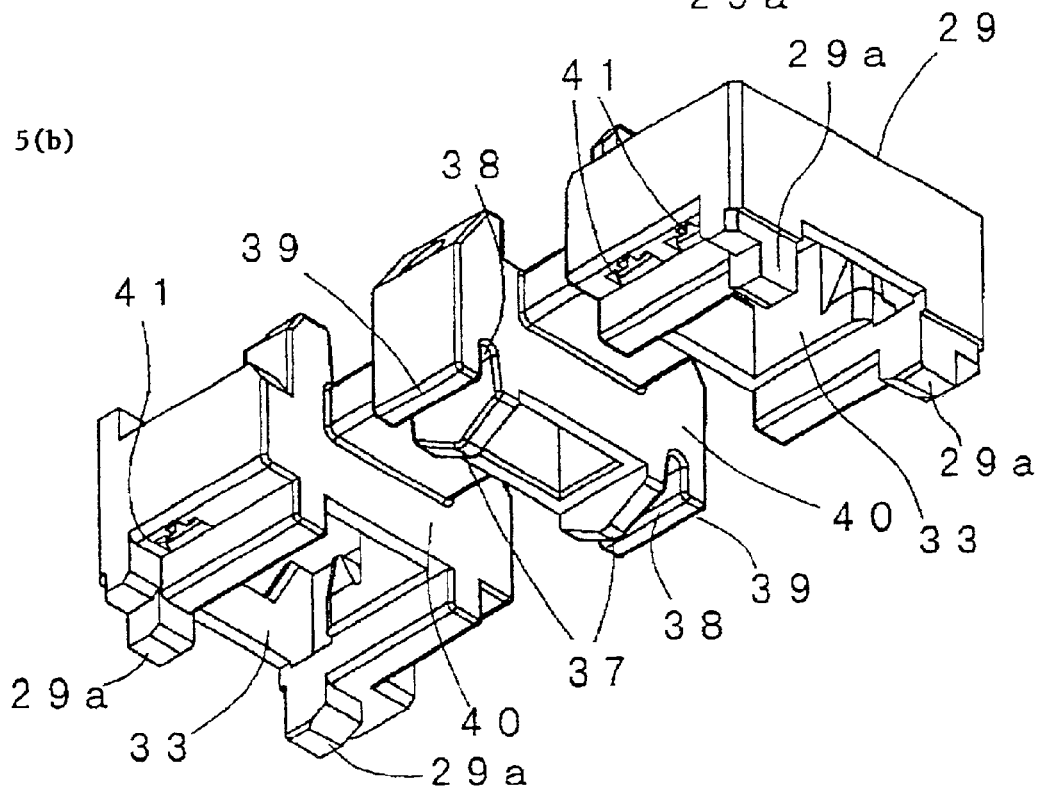
FIG. 5B is its downward side perspective view.

The spool 29 has relief portions 33 communicating with the upper and lower parts at both ends as shown in FIGS. 5(*a*) and (*b*). Inside of the relief portion 33, a thermal caulking portion 34 is formed for fixing the iron core 30 as mentioned below. The relief unit 33 is communicated with an accommodating groove 35 formed in the upper plane. In the middle of the accommodating groove 35, there is an accommodating hole 36 disposing the permanent magnet 31. At both sides of the lower edge of the accommodating hole 36, as shown in FIG. 5B, a substantially triangular fulcrum 37 is provided, and a pressing portion 39 is provided through a groove 38 at its side. Both side walls of the accommodating groove 35 are inclined on the outer surface, and cut off at two opposite positions. Thereby, coil winding portions 40 are formed, respectively. At one side edge of the spool 29, terminal holes 41 penetrating vertically are drilled in plural positions, and a coil terminal 42 (see FIG. 6A) is press-fitted, respectively. At each corner of lower plane of the spool 29, a fitting protrusion 29*a* to be fitted in the fitting recess 4*a* of the base 4 is formed, respectively.

Figure 6A:
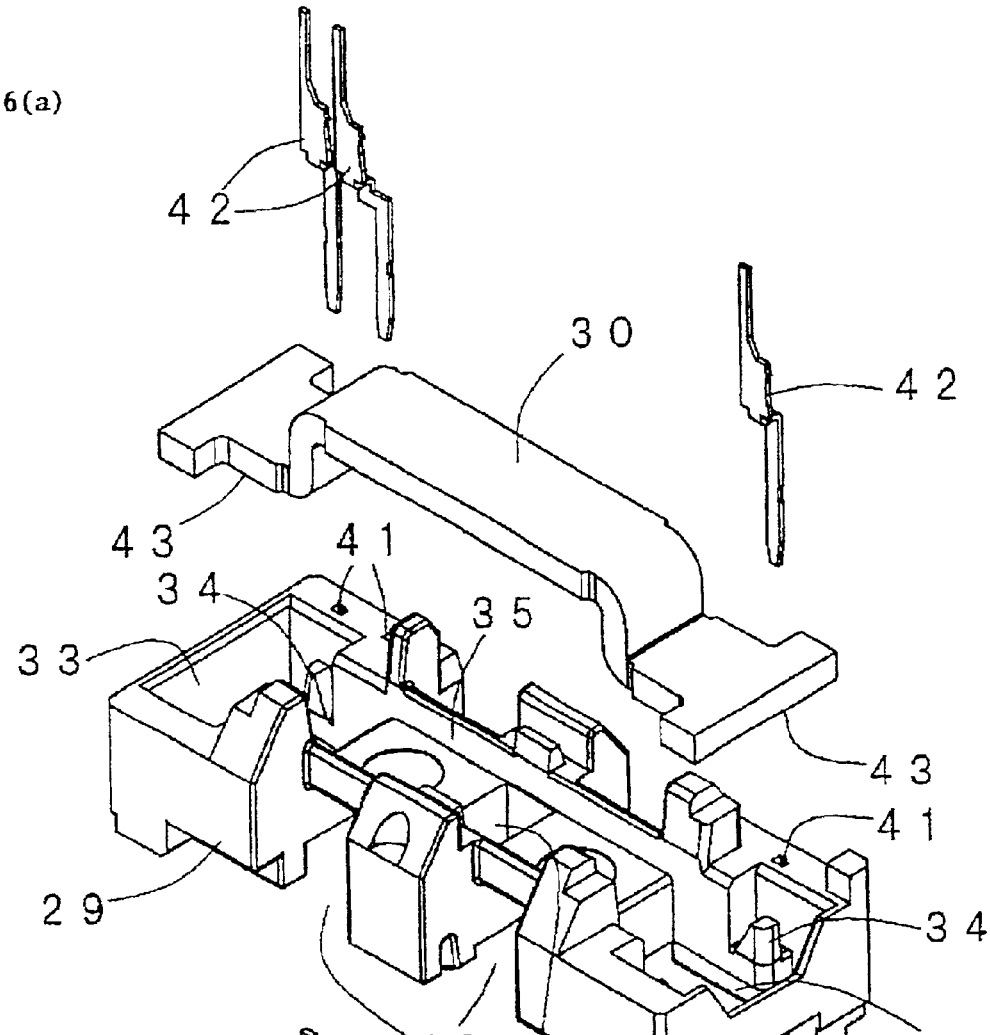
FIG. 6A is an exploded perspective view of the electromagnet block shown in FIG. 2.
Figure 6B:
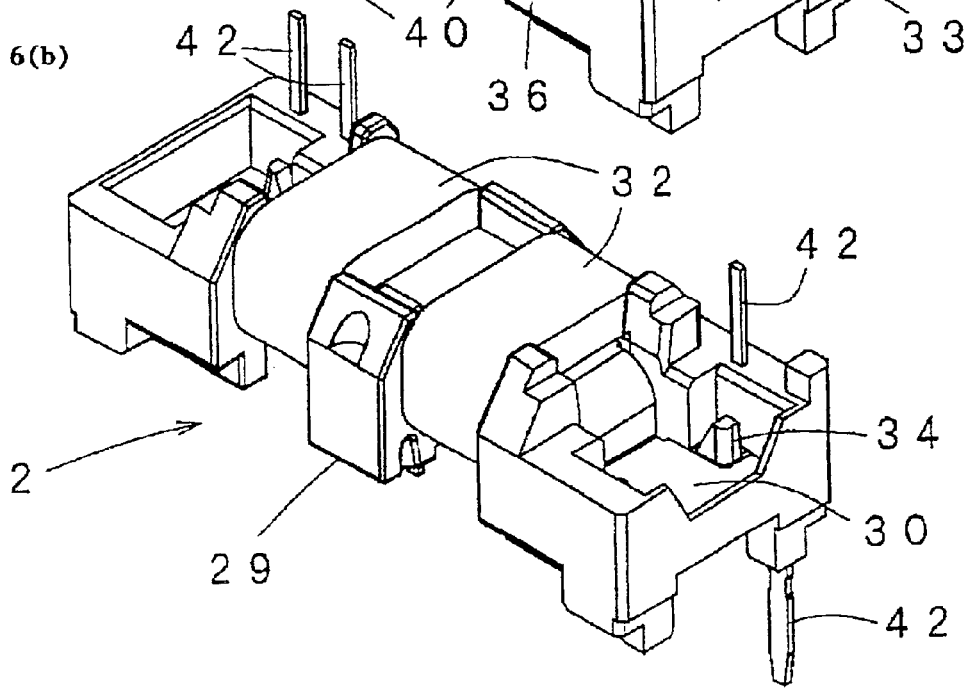
FIG. 6B is a perspective view of electromagnet block shown in FIG. 2.

The iron core 30 is formed by folding the both ends of a magnetic plate material in stairs as shown in FIG. 6A. Lower planes at both ends compose a suction plane 43 exposed downward in the relief portion 33 of the spool 29.

The permanent magnet 31 is substantially rectangularly parallelepiped, and is disposed in the accommodating hole 36 of the spool 29 so that different polarities may be positioned at upper and lower positions, respectively.

Figure 7:
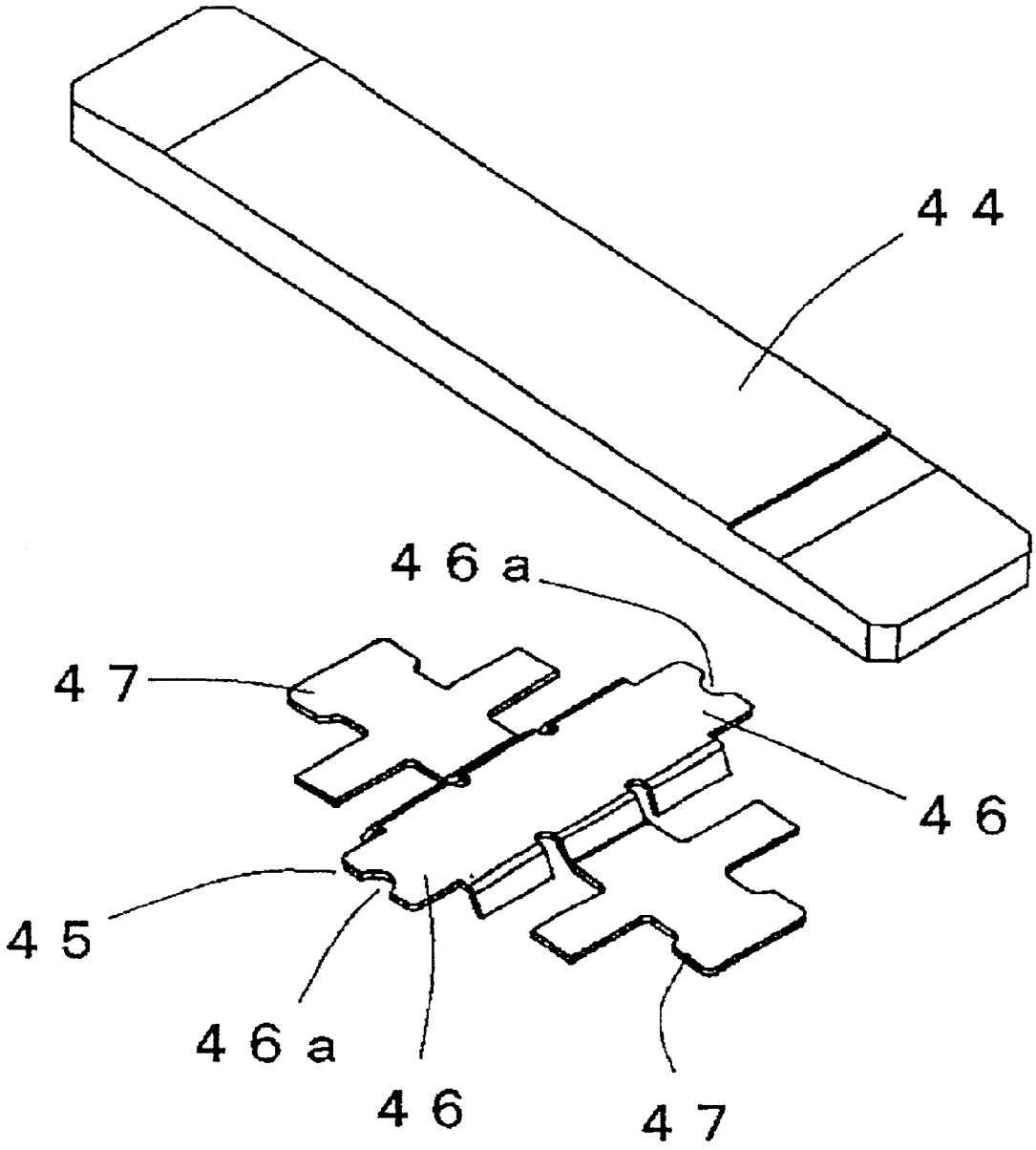
FIG. 7 is a perspective exploded view of the movable ion piece shown in FIG. 2.

Beneath the electromagnetic block 2, a movable ion piece 44 made of a magnetic plate material is disposed. As shown in FIG. 7, slopes are formed at both ends of the upper plane of the movable iron piece 44 to make face-to-face contact when sucked in the suction plane 43 of the iron core 30. A pressure spring 45 is attached in the lower middle part of the movable iron piece 44 by welding, caulking or the like. The pressure spring 45 is composed of a positioning portion 46 extended from both sides of the movable iron piece 44, and a pressing portion 47 orthogonal to the positioning portion 46 and projecting downward and slanted. A stopping recess 46*a* is formed in the positioning portion 46. The stopping recess 46*a* is stopped by the stopping protrusion 7 formed in the base 4, and the movable iron piece 44 is positioned. The pressing portion 47 presses the support portion 17 of the movable block 15 downward.

The case 3 is a substantial box opened in the downward direction as shown in FIG. 1. Gas vents 48 are formed at corners of the upper plane.

A manufacturing method of the electromagnetic relay is described. This electromagnetic relay is formed, roughly speaking, by forming a base block 1 and an electromagnet block 2, assembling the electromagnet block 2 in the base block 1, and putting on a case 3.

Figure 8:
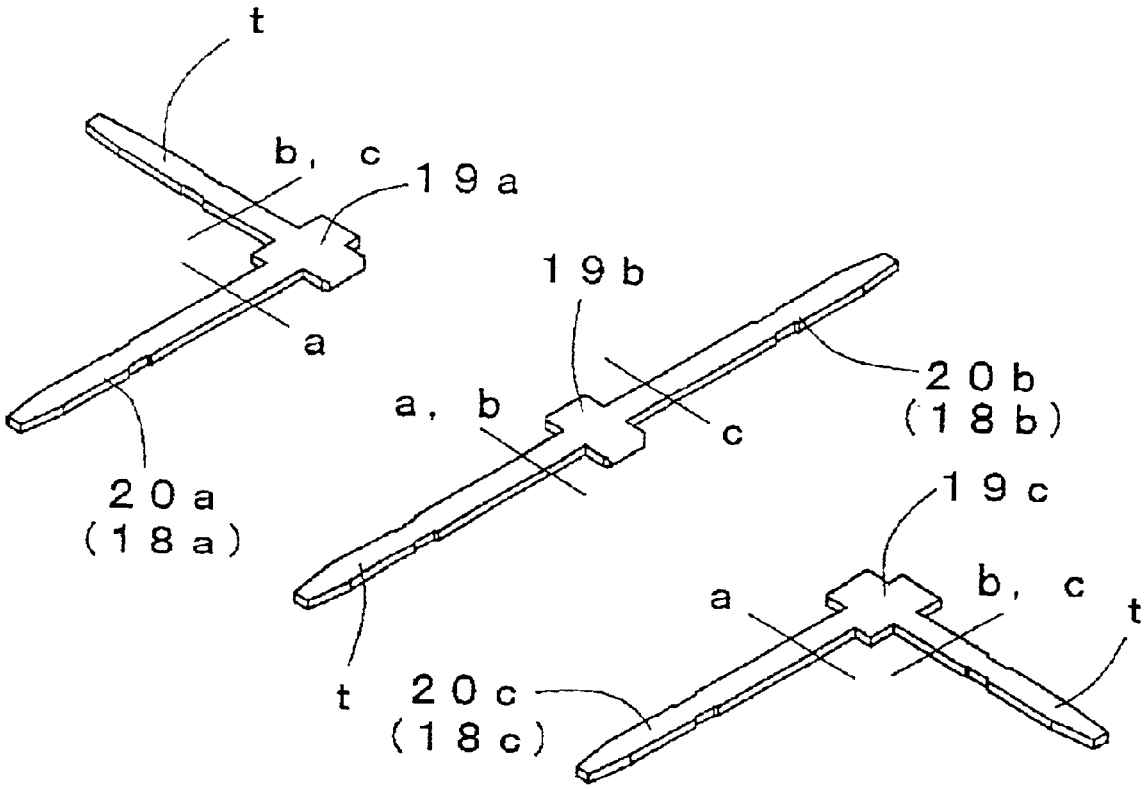
FIG. 8 is a perspective view showing a sample layout of the fixed terminals shown in FIG. 2.
Figure 9A:
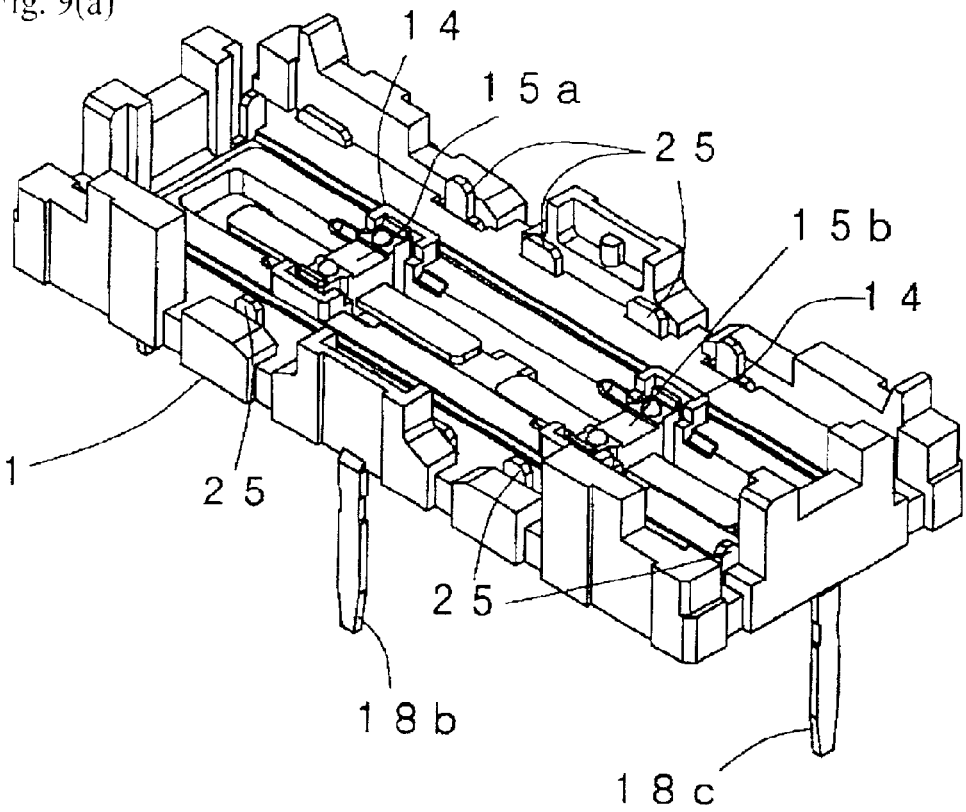
FIG. 9A is an upward side perspective view showing a state before assembling the upper shielding plate of the base block shown in FIG. 2.
Figure 9B:
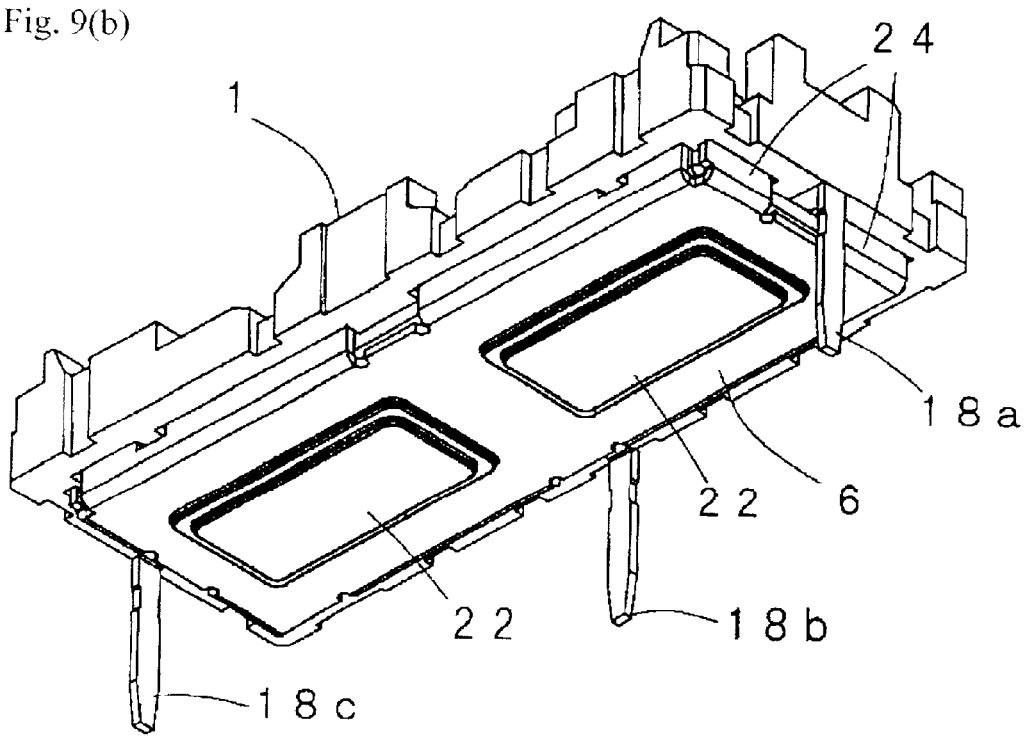
FIG. 9B is its downward side perspective view.
Figure 10A:
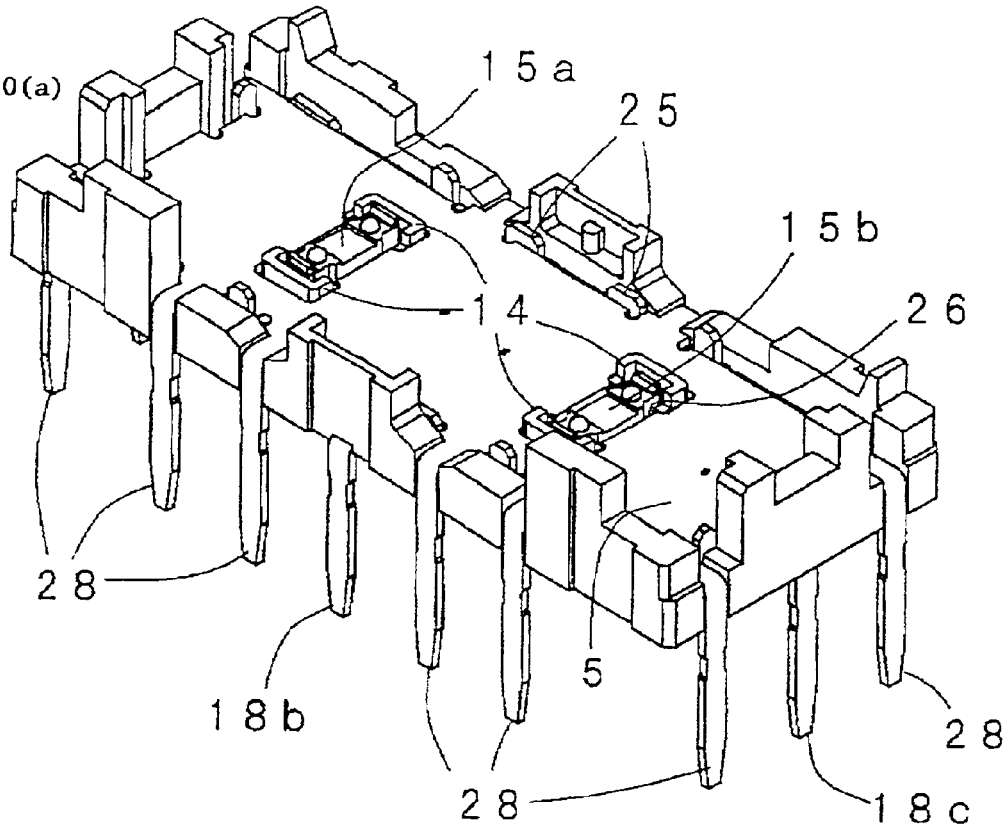
FIG. 10A is an upward side perspective view of base block shown in FIG. 2.
Figure 10B:
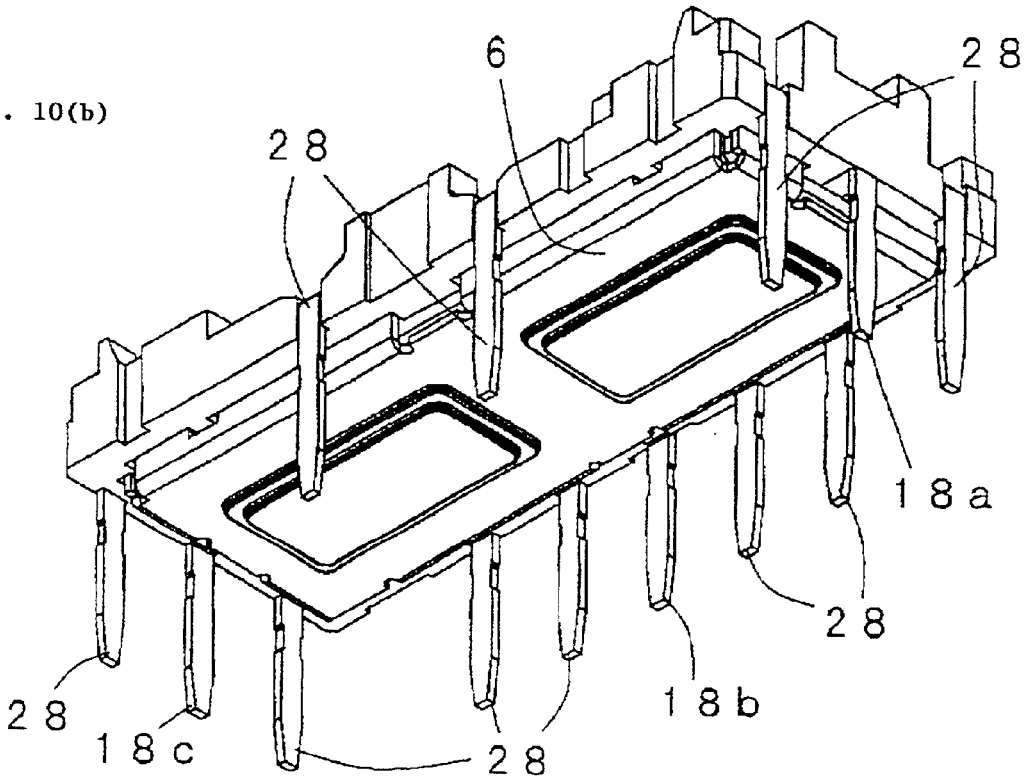
FIG. 10B is its downward side perspective view.

First, to form the base block 1, a lead frame, not shown, is blanked to form fixed terminals 18*a*, 18*b*, 18*c*, and conveyed into a die to form a base 4 by an insert molding method. FIG. 8 shows a layout example of the fixed terminals 18*a*, 18*b*, 18*c*. Herein, three example layouts can be selected by picking up terminal t out of six terminals t as fixed terminals 18*a*, 18*b*, 18*c*. That is, the terminals t not used as fixed terminals 18 are cut off at any one of positions a, b, c, are cut off from the fixed contacts 19*a*, 19*b*, 19*c*, and are removed from the base 4 after insert molding. However, terminals t extending from the fixed contacts 19*a*, 19*b*, 19*c* are not limited to two, but may be three or more, and the number of fixed contacts may be four or more. Subsequently, a return spring 23 is attached in the upper middle of the lower shielding plate 6, and, as shown in FIGS. 9(*a*) and (*b*), this lower shielding plate 6 is disposed at the lower plane of the base 4, and the movable guide 15 at the guide groove 14, respectively. At this time, the fixed terminal portions 20*a*, 20*b*, 20*c* are bent downward, and the positional relationship with the lower shielding plate 5 is maintained as almost constant. Further, as shown in FIGS. 10(*a*) and (*b*), the upper shielding plate 5 is disposed on the upper plane of the base 4. At this time, the outer edge of the upper shielding plate 5 and the raised wall 24 of the lower shielding plate 6 make contact with each other. The earth terminal 28 of the upper shielding plate 5 is positioned at the relief groove 12 of the base 4, and is also positioned at both sides of the terminal portions 20*a*, 20*b*, 20*c* of the fixed terminals 18*a*, 18*b*, 18*c*. Further, the support portion 17 of the movable blocks 15*a*, 15*b* is raised up by the thrusting force of the return spring 23, and is positioned at the insertion hole 26 of the upper shielding plate 5. By folding the stopping piece 25 provided in the raised wall 24, the members are integrally formed, and the base block 1 (see FIG. 10) is completed.

In the completed base block 1, the movable contact pieces 16*a*, 16*b*, 16*c* move parallel in the vertical direction to the fixed contact portions 19*a*, 19*b*, 19*c* of the fixed terminals 18*a*, 18*b*, 18*c*. That is, signal lines composed of the fixed terminals 18*a*, 18*b*, 18*c* and movable contact pieces 16*a*, 16*b* are positioned parallel to the upper shielding plate 5 and lower shielding plate 6, and thereby strip lines are composed. At the side of the signal lines, the earth terminal 28 of the upper shielding plate 5 and raised wall 24 of the lower shielding plate 6 are positioned. Thereby, the surrounding is covered with the shielding plates 5, 6. Accordingly, smaller effects from surrounding noise are observed, the isolation characteristic is enhanced, and thus, the loss is decreased.

In forming the electromagnet block 2, the iron core 30 is disposed in the accommodating groove 35 of the spool 29. The iron core 30 has both its ends folded in stairs, and is positioned in the relief portion 33 of the spool 29. The suction plane 43 is exposed to the lower plane side. The thermal caulking portion 34 is heated and fused, and the iron core 30 is fixed in the spool 29. The permanent magnet 31 is accommodated in the accommodating hole 36 from beneath, the coil terminal 42 is press-fitted into the terminal hole 41, and the coil 32 is wound around the coil winding portion 40. Both ends of the coil 32 are wound around the upper end of each coil terminal 42 and folded inside so that the electromagnet block 2 (see FIG. 6A) is completed.

Figure 11:
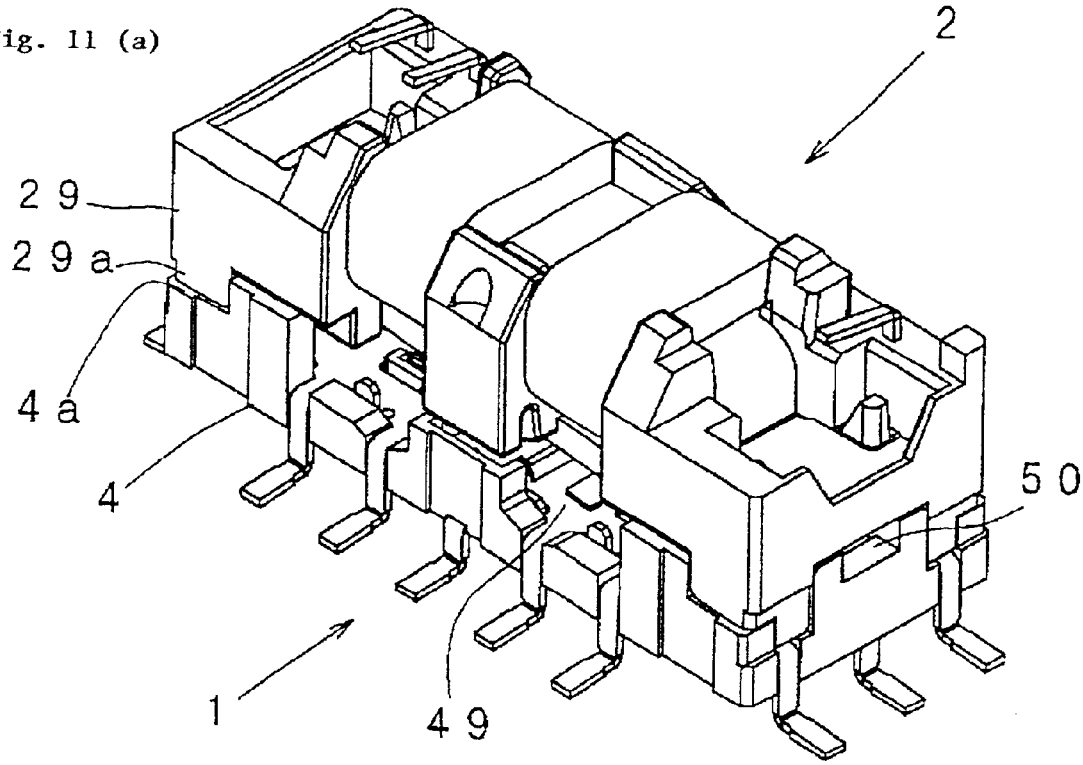
FIG. 11A is an upward side perspective view showing a state after assembling the electromagnet block in the base block shown in FIG. 2.
FIG. 11B is its downward side perspective view.
Figure 11B:
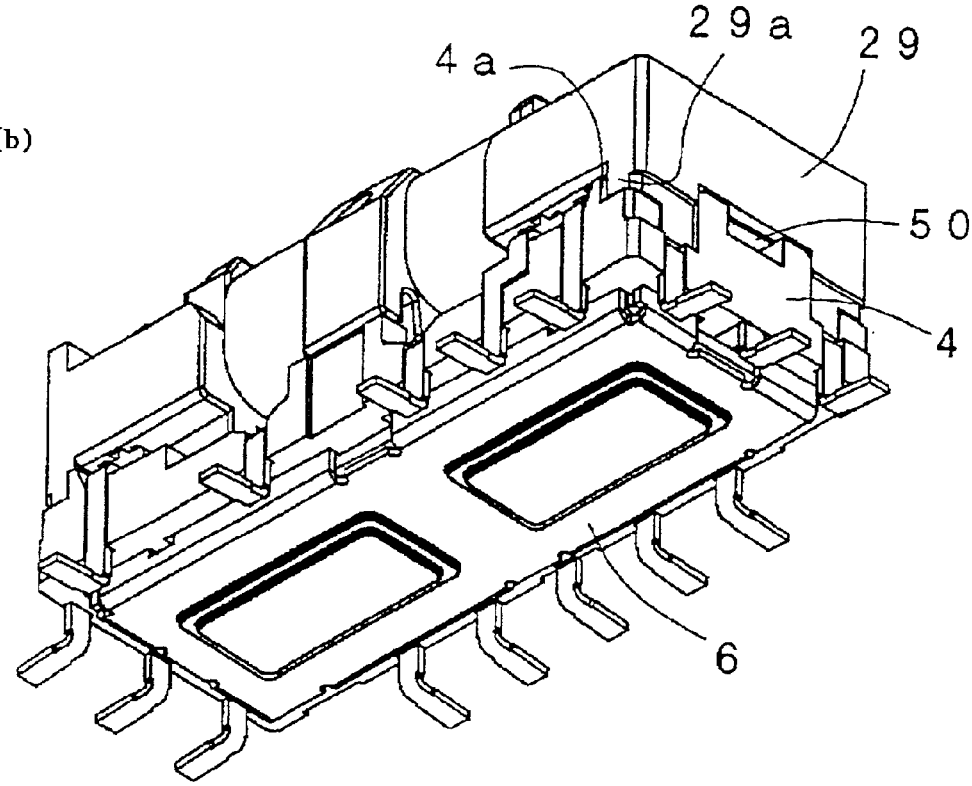

Moreover, when assembling the electromagnet block 2 into the base block 1, the movable iron piece 44 having the pressure spring 45 is disposed above the base block 1. The movable iron piece 44 has the positioning portion 46 of the pressure spring 45 guided by the guide wall 8 of the base 4, and is positioned as the stopping protrusion 7 and is stopped by the stopping recess 46*a*. As shown in FIGS. 11(*a*) and (*b*), the fitting recess 4*a* of the base 4 is fitted into the fitting protrusion 29*a* of the spool 29, and the fitting portions are heated, fused and adhered so that the electromagnet block 2 is assembled in the base block 1. At this time, the positioning portion 46 of the pressure spring 45 guided by the guide wall 8 is supported by the pressing portion 39 of the spool 29. The support portion 37 abuts against the pressure spring 45, and the movable iron piece 44 is supported rotatably about this fulcrum 37. A window 49 is formed by the notch between the first side wall 9 and second side wall 10 of the base 4 and the side walls of the electromagnet block 2. At this time, by changing the bending angle of the pressure spring 45 through the window 49 and adjusting the contact point pressure, a desired operation characteristic is obtained. A window 50 is formed by the recess 11*a* formed in the third side wall 11 of the base 4 and the spool 29. Through this window 50, the operation of the movable iron piece 44 can be monitored.

The case 3 is fitted into the base 4 to cover the components during assembly of the electromagnet block 2 in the base block 1. On the fitting surface, an adhesive is applied and cured at a high temperature to fix firmly. Then the gas vent holes 48 are sealed by heat, and the inside is tightly enclosed.

The operation of this electromagnetic relay is explained below.

The electromagnetic relay is used by mounting it on a printed wiring board not shown. In this case, by folding the fixed terminals 18*a*, 18*b*, 18*c*, and 28 projecting downward in stairs substantially in a right-angle direction, the conductive parts of the printed circuit board and the grounding parts are connected by soldering, respectively. By changing the current feed direction in the coil 32, a first signal line composed of fixed terminal 18, movable contact piece 16*a*, and fixed; terminal 18*b*, and a second signal line composed of fixed terminal 18*c*, movable contact piece 16*b*, and fixed terminal 18*b* are changed over.

Figure 12:
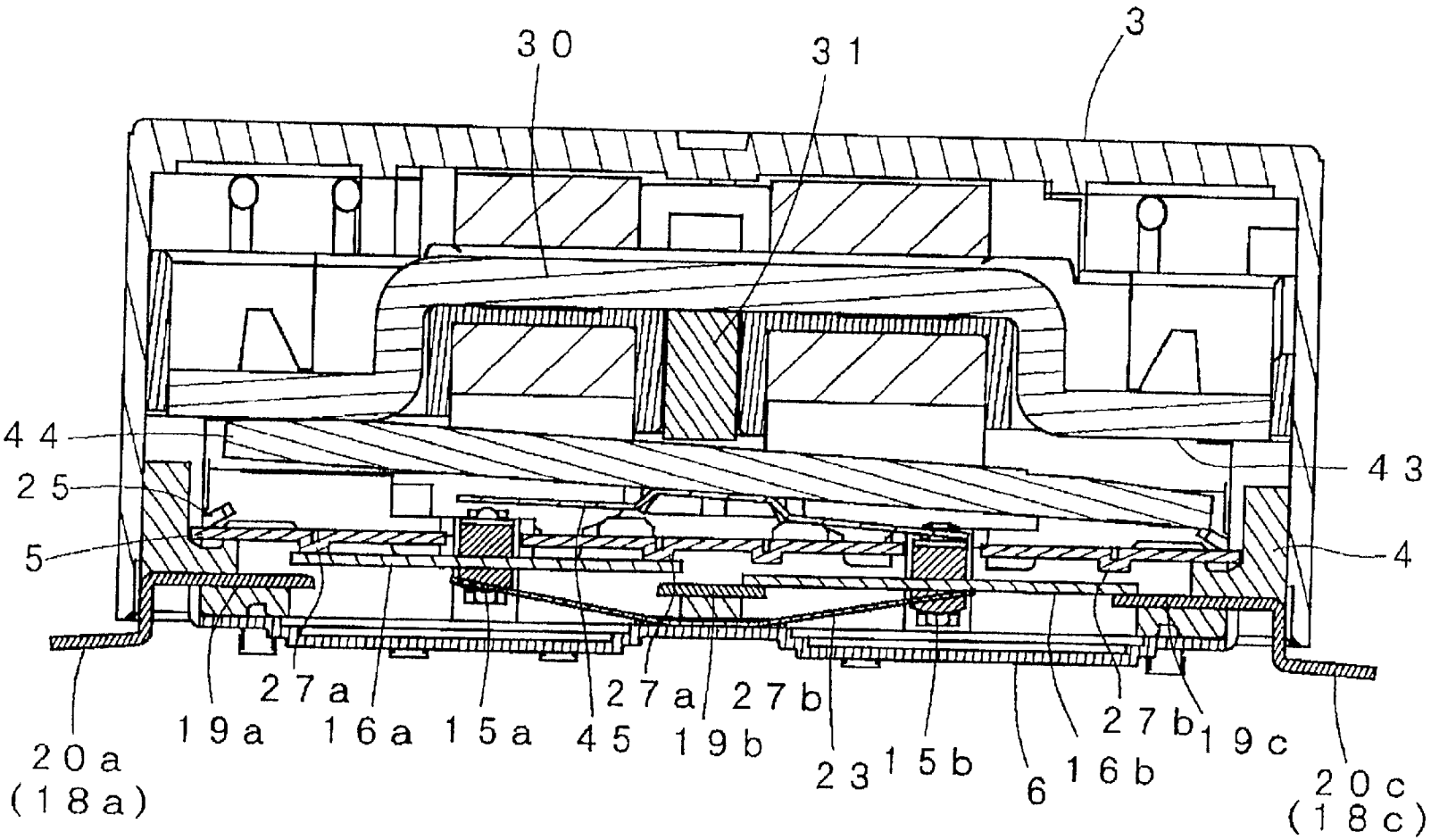
FIG. 12 is a sectional view of the electromagnetic relay shown in FIG. 1.

That is, by exciting the electromagnet block 2 by feeding current in the coil 32, as shown in FIG. 12, one end of the movable iron piece 44 is sucked to one suction plane 43 of the iron core 30. As a result, an end of the pressure spring 45 pushes down one movable block 15*a* by overcoming the thrusting force of the return spring 23. Consequently, the movable contact piece 16*b* makes contact with the fixed contacts 19*b*, 19*c*, and a high frequency signal can be transmitted through the second signal line. Another movable block 15*a* is moved upward by the thrusting force of the return spring 23 and the movable contact piece 16*a* abuts against the earth contact 27*a* of the upper shielding plate 5. Accordingly, without adversely effecting the second signal line formed above, the distance between the contacts is always kept constant. In this state, since the magnetic circuit is closed by the permanent magnet 31, the movable iron piece 44, and iron core 44, the movable iron piece 44 is maintained rotatably even if the current feed to the coil 32 is shielded. Thus, the movable contact piece 16*b* may not depart from the fixed terminals 18*b*, 18*c*.

On the other hand, when the current feed direction in the coil 32 is inverted, the polarity is inverted on each suction plane 43 of the iron core 30, and the movable iron core 44 rotates the fulcrum 37 (see FIG. 5B) from the state shown in FIG. 12 in the counterclockwise direction. As a result, the movable contact piece 16*b* is moved upward by the thrusting force of the return spring 23, and departs from the fixed contact portions 19*b*, 19*c* to abut against the earth contact portion 27*b* of the upper shielding plate 5. As the thrusting force from the pressure spring 45 increases, the movable contact piece 16*a* is moved downward by resisting the thrusting force of the return spring 23, and contacts with the fixed contact portions 19*a*, 19*b* so that a high frequency signal can be transmitted through the first signal line.

The signal lines changed over are very close to each other, nearly parallel to the printed wiring board on which the electromagnetic relay is mounted, and the upper, lower and side portions are enclosed by the shielding plates 5, 6 through a space. Therefore, the isolation characteristic is very high, and the loss is small. Hence, high frequency signals can be transmitted adequately.

In the foregoing embodiments, the slits 21*a* are formed in the base 4, and the raised wall 24 of the lower shielding plate 6 is positioned in this slit 21 so that the side portion is also shielded. However, a shielding layer may be formed inside of the opening of the base 4 by plating, vapor deposition or other method, and this shielding layer may be grounded.

Figure 13A:
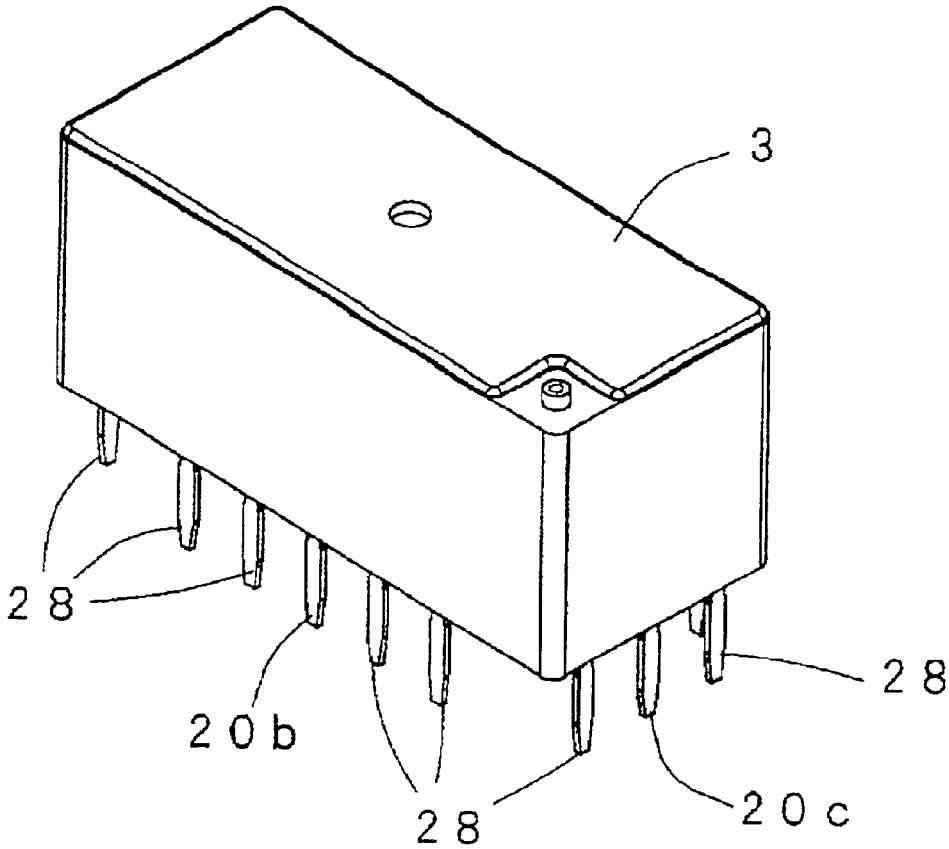
FIG. 13A is an upward side perspective view of an electromagnetic relay according to another embodiment.
Figure 13B:
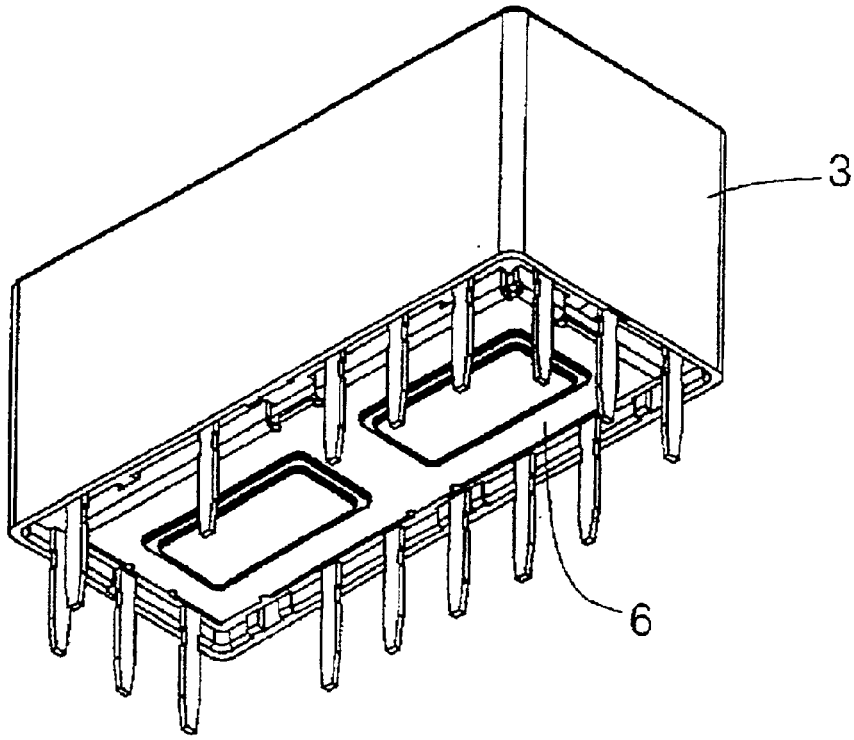
FIG. 13B is its downward side perspective view.

In the embodiments, the fixed terminals 18*a*, 18*b*, 18*c* are folded in stairs, but they may be used directly as shown in FIGS. 13(*a*) and (*b*).

Also in the embodiments, the return spring 23 is disposed in the middle of the upper plane of the lower shielding plate 6. However, it may be disposed, for example, in the upper shielding plate 5, and the movable blocks 15*a*, 15*b* may be pressed downward.

As apparent from the description herein, according to the invention, since the signal lines formed by the fixed terminals and movable contact pieces of the movable block are disposed in the internal space of the base, and shielding portions to be grounded are disposed in the upper or lower part to correspond to the signal lines, the isolation characteristic is enhanced and the loss can be kept to a minimum.

What is claimed is:

1. An electromagnetic relay, comprising:

a plurality of fixed terminals, each having fixed contacts;

a movable block holding a movable contact piece having a movable contact point contacting with and departing from the fixed contacts; and an electromagnetic block for driving the movable block, wherein the fixed contacts are opened or closed by driving the movable block by exciting or not exciting the electromagnet block to transmit or shield a high frequency signal, each fixed terminal is supported by a side of a base composed of a dielectric material and having an internal space and upper and lower planes and four sides, the fixed contact of each fixed terminal is exposed to the internal space, a surface of the fixed terminal is disposed parallel to a bottom of the base, while the movable block is disposed in the internal space of the base, signal lines are formed of the fixed terminals and the movable contact piece, and shielding portions to be grounded are disposed at either an upper part or a lower part of the internal space corresponding to the signal lines, the shielding portions having a plurality of terminals extended from at least two opposite sides of an edge of the shielding portions and lying in a horizontal position with respect to the relay.

2. The electromagnetic relay according to claim 1, wherein the internal space of the base is covered by positioning the shielding portions at the upper and lower planes and four sides of the base.

3. The electromagnetic relay according to claim 1, wherein the shielding portions are disposed at the upper and lower planes of the base, and are mutually electrically connected.

4. The electromagnetic relay according to claim 1, wherein the movable block is composed of a support portion movably supported in a vertical direction by a guide portion formed inside of the internal space of the base, and a movable contact piece extended from the support portion and having a movable contact to make contact with and depart from the respective fixed contacts at both ends thereof.

5. The electromagnetic relay according to claim 4, wherein the guide portion supports the support portion of said movable block to be vertically movable by partial contact.

6. The electromagnetic relay according to claim 4, wherein a biasing element for biasing the movable contact piece to maintain the movable contact point in open state or closed state is provided in the upper or lower planes of the base.

7. The electromagnetic relay according to claim 4, wherein protrusions for abutting against the movable contact piece in an open state to maintain a constant distance between the movable contact pieces are provided in the shielding portions.

8. The electromagnetic relay according to claim 1, wherein recesses for keeping a constant distance to the signal lines to maintain a characteristic impedance constant are formed in the shielding portions.

9. The electromagnetic relay according to claim 1, wherein the lower plane of the base is formed in the shielding portions, and protrusions are formed in the shielding portions.

10. The electromagnetic relay according to claim 1, wherein the lower plane of the base is formed in the shielding portions, and a stand-off is formed so as to provide a clearance between the lower plane of the base and an upper plane of a printed wiring board when abutting against the upper plane of the printed wiring board.

11. The electromagnetic relay according to claim 1, wherein a shielding plane to be grounded is formed in an area where at least shielding portions are not provided, in the inside of the internal space of the base.

12. The electromagnetic relay according to claim 1, wherein the shielding portions are provided in the lower plane of the base, and the characteristic impedance is kept constant by bending the signal terminal extended from the base and connected to the signal lines so as to maintain a specified dimension to the shielding portions.

13. The electromagnetic relay according to claim 1, wherein earth terminals to be connected to the shielding portions provided in the lower plane of the base are disposed at both sides of the signal terminal extended from the base and connected to the signal line.

* * * * *